US009027195B1

(12) United States Patent
Rhee

(10) Patent No.: US 9,027,195 B1
(45) Date of Patent: May 12, 2015

(54) AUXILIARY HANDLE ATTACHMENT FOR A CLEANING SPONGE AND THE COMBINED ASSEMBLY

(76) Inventor: Kyung Tai Rhee, Little Silver, NJ (US)

( * ) Notice: Subject to any disclaimer, the term of this patent is extended or adjusted under 35 U.S.C. 154(b) by 264 days.

(21) Appl. No.: 13/371,395

(22) Filed: Feb. 11, 2012

(51) Int. Cl.
*A47L 13/10* (2006.01)
*A47L 13/16* (2006.01)
*A47L 13/46* (2006.01)

(52) U.S. Cl.
CPC *A47L 13/16* (2013.01); *A47L 13/46* (2013.01)

(58) Field of Classification Search
None
See application file for complete search history.

(56) References Cited

U.S. PATENT DOCUMENTS 6,379,237 B1 * 4/2002 Gordon ..... 451/523
6,385,806 B1 * 5/2002 Katakura et al. ..... 15/104.94
6,425,701 B1 7/2002 Jacobs
D636,955 S * 4/2011 Armaly, Jr. ..... D32/40
2002/0116777 A1 * 8/2002 Morad et al. ..... 15/119.2

* cited by examiner

*Primary Examiner* — Monica Carter
*Assistant Examiner* — Stephanie Berry
(74) *Attorney, Agent, or Firm* — LaMorte & Associates, P.C.

(57) ABSTRACT

A cleaning implement having a sponge and an assembly for engaging and manipulating the sponge. The assembly includes a gripper head having a receptacle area that is defined within a peripheral wall. Hook elements are provided that laterally extend into the receptacle area from the peripheral wall. A handle extends from the gripper head. The handle may be selectively detachable from the gripper head. A sponge is provided, wherein a segment of the sponge is deformed into the receptacle area. The deformed section of the sponge is hooked by the hook elements in the receptacle area. This mechanically interconnects the sponge with the gripper head.

14 Claims, 4 Drawing Sheets

AUXILIARY HANDLE ATTACHMENT FOR A CLEANING SPONGE AND THE COMBINED ASSEMBLY

BACKGROUND OF THE INVENTION

1. Field of the Invention

In general, the present invention relates to devices that contain a sponge for cleaning and a handle that attaches to the sponge to help manipulate the sponge. More particularly, the present invention relates to the mechanisms used to interconnect a cleaning sponge with an auxiliary handle.

2. Prior Art Description

When people elect to wash pots, pans, dishes and the like at the kitchen sink, they typically utilize a sponge to assist in the task. The sponge is capable of retaining significant amounts of both water and detergent, therein making the soaping of the dirty dishes as easy as running the sponge over the surfaces of the dishes.

In the past, cleanings sponges were made from natural sea sponges. However, in modern times, most all sponges are manufactured from open cell synthetic plastic foam. Modern manufacturing techniques have made sponges inexpensive and disposable, wherein the average American household replaces its kitchen sponge on a nearly weekly basis.

Many modern sponges are now also manufactured with a scrubbing surface on one side. The scrubbing surface is made from a dense nap of polymer fibers. The scrubbing surface can be used to scrub away stubborn material on the dirty dishes. However, the scrubbing surface does not scratch non-stick surfaces on pots and pans, as would steel wool.

A problem commonly associated with the use of sponges during cleaning is that the sponge must be manually grasped in order to be manipulated. This brings a person's hand into contact with the water and detergents retained by the sponge for as long as the sponge is in use. The exposure to water and detergent can cause dishpan hands that are pruned from exposure to water. The exposure to detergents may also cause natural skin oils to become depleted. This can cause the skin on the hands to become dry, red and chapped.

There are many techniques that can be used to prevent contact between the hands and a wet sponge. The obvious solution is for a person to wear waterproof gloves when washing dishes. However, the gloves are typically more expensive than the sponge. Furthermore, it is inconvenient to have to put on and take off gloves every time the sponge is used at the sink.

Another solution used to prevent skin contact with a sponge is to attach a handle to the sponge and grasp the handle. However, in the prior art, in order to attach a handle to a sponge, a specialty sponge and handle assembly must be purchased, wherein the sponge and handle share a connector that enables the sponge to be attached to the handle. Such prior art systems are exemplified by U.S. Pat. No. 6,425,701 to Jacobs, entitled Liquid Dispensing Handle.

The obvious problem with systems that have dedicated sponges and handles, is that the handles can only be attached to the specialized sponges that are sold as part of the system. The specialty replacement sponges inevitably cost more than ordinary sponges. Furthermore, if the product is ever discontinued and the specialty sponges become unavailable, the handle has no practical use.

A need therefore exists for an auxiliary handle that can attach to most any ordinary sponge. A need also exists for a handle that can be attached to either the sponge material of the sponge or the scrubbing nap on the sponge, so that the sponge can be reversed when needed. In this manner, any inexpensive sponge can be attached to the handle and utilized without the user's hands having to contact the water and detergents retained by the sponge. This need is met by the present invention as described and claimed below.

SUMMARY OF THE INVENTION

The present invention is a cleaning implement comprised of a sponge and an assembly for engaging and manipulating the sponge. The assembly includes a gripper head having a receptacle area that is defined within a peripheral wall. Hook elements are provided that laterally extend into the receptacle area from the peripheral wall.

A handle extends from said gripper head. The handle may be selectively detachable from the gripper head.

A sponge is provided, wherein a segment of the sponge is deformed into the receptacle area. The deformed section of the sponge is hooked by the hook elements in the receptacle area. This mechanically interconnects the sponge with the gripper head.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention auxiliary handle assembly can be embodied in many ways to engage sponges of different sizes and shapes, a single embodiment is illustrated for the purpose of simplicity. The embodiment selected is one of the best modes contemplated for the invention. The illustrated embodiment, however, is merely exemplary and should not be considered a limitation when interpreting the scope of the appended claims.

Figure 1:
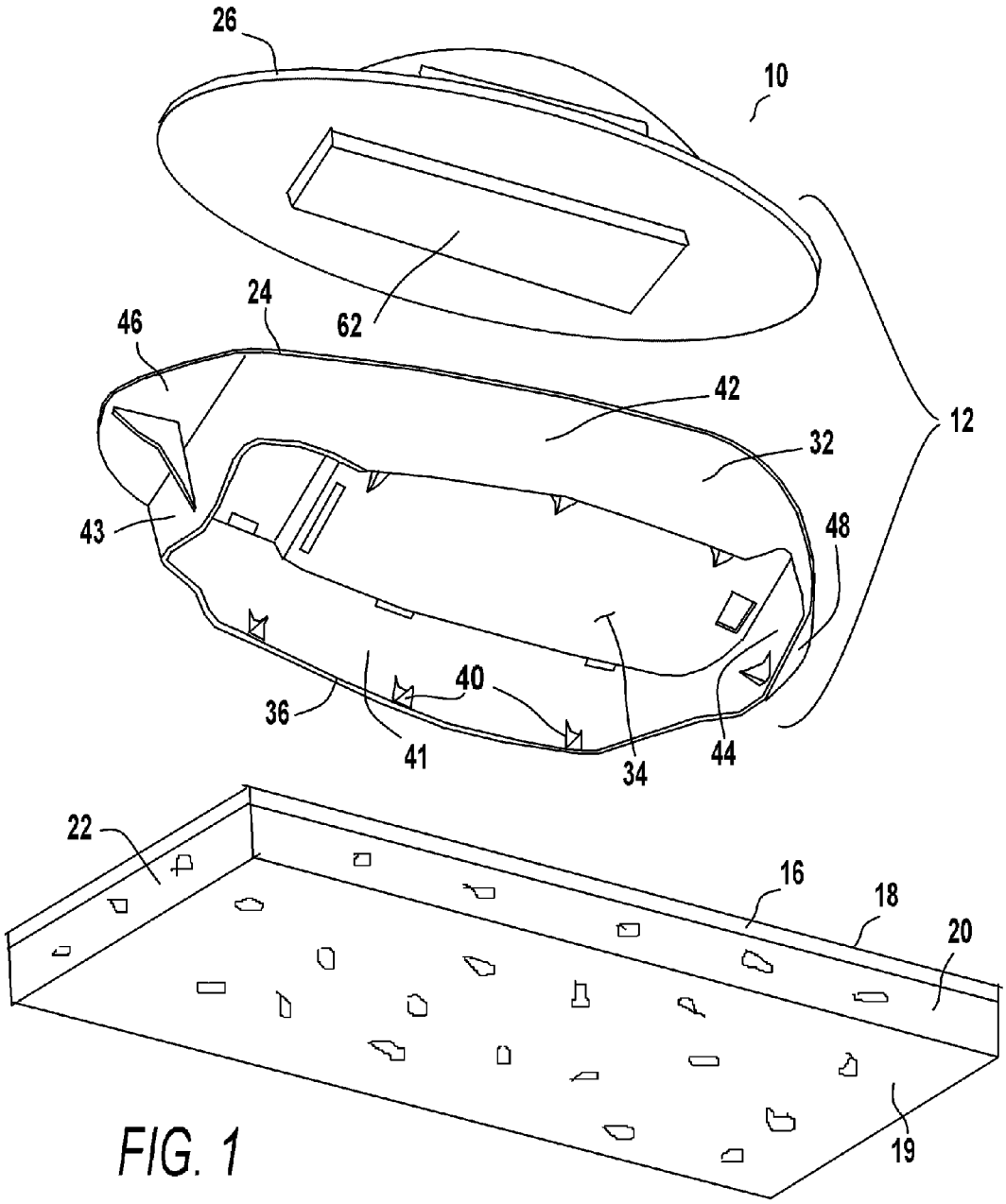
FIG. 1 is an exploded bottom perspective view of an exemplary embodiment of the present invention assembly.
Figure 2:
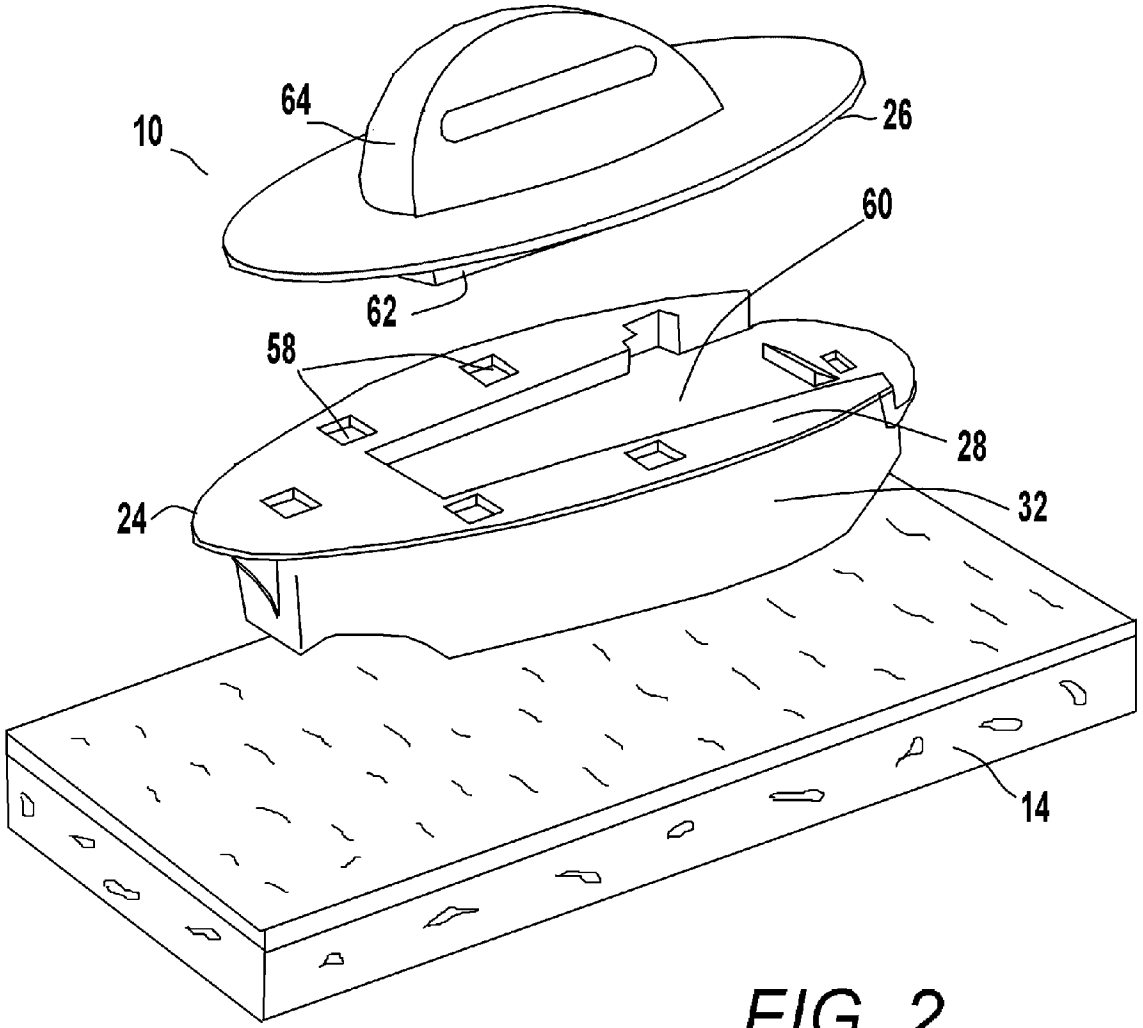
FIG. 2 is an exploded top perspective view of an exemplary embodiment of the present invention assembly.

Referring to both FIG. 1 and FIG. 2, an assembly 10 is illustrated. The assembly 10 includes an auxiliary handle sub-assembly 12 that is shown in conjunction with a typical inexpensive sponge 14. The sponge 14 is of the type having a layer of a scrubbing nap 16 that covers the top of the sponge 14. Accordingly, the sponge 14 has a top surface 18 of scrubbing nap 16, a bottom surface 19 of sponge material 20, and four side surfaces 22 that contain both the sponge material 20 and the material of the scrubbing nap 16.

The auxiliary handle sub-assembly 12 contains two components. Those components include a gripper head 24 and a handle 26. The gripper head 24 engages the sponge 14 in a manner that is later described in detail. The handle 26 can be selectively attached to the gripper head 24. It will therefore be understood that the gripper head 24 interconnects the sponge 14 to the handle 26 in the full assembly 10.

The gripper head 24 has a base plate 28. The base plate 28 has a top surface 29 and a bottom surface 30. The base plate 28 has an oblong peripheral shape in the exemplary embodiment. However, it should be understood that other shapes can also be used.

A vertical wall 32 extends downwardly from the bottom surface 30 of the base plate 28. The vertical wall 32 is continuous as it progresses in a closed loop. The vertical wall 32 generally follows the oblong peripheral shape of the base plate 28. The bottom surface 30 of the base plate 28 and the vertical wall 32 combine to form a receptacle space 34. The receptacle space 34 has a bottom that is defined by the base plate 28 and sides that are defined by the vertical wall 32. The vertical wall 32 extends from the base plate 28 and terminates at an open edge 36, therein creating an opening for accessing the receptacle space 34.

Figure 3:
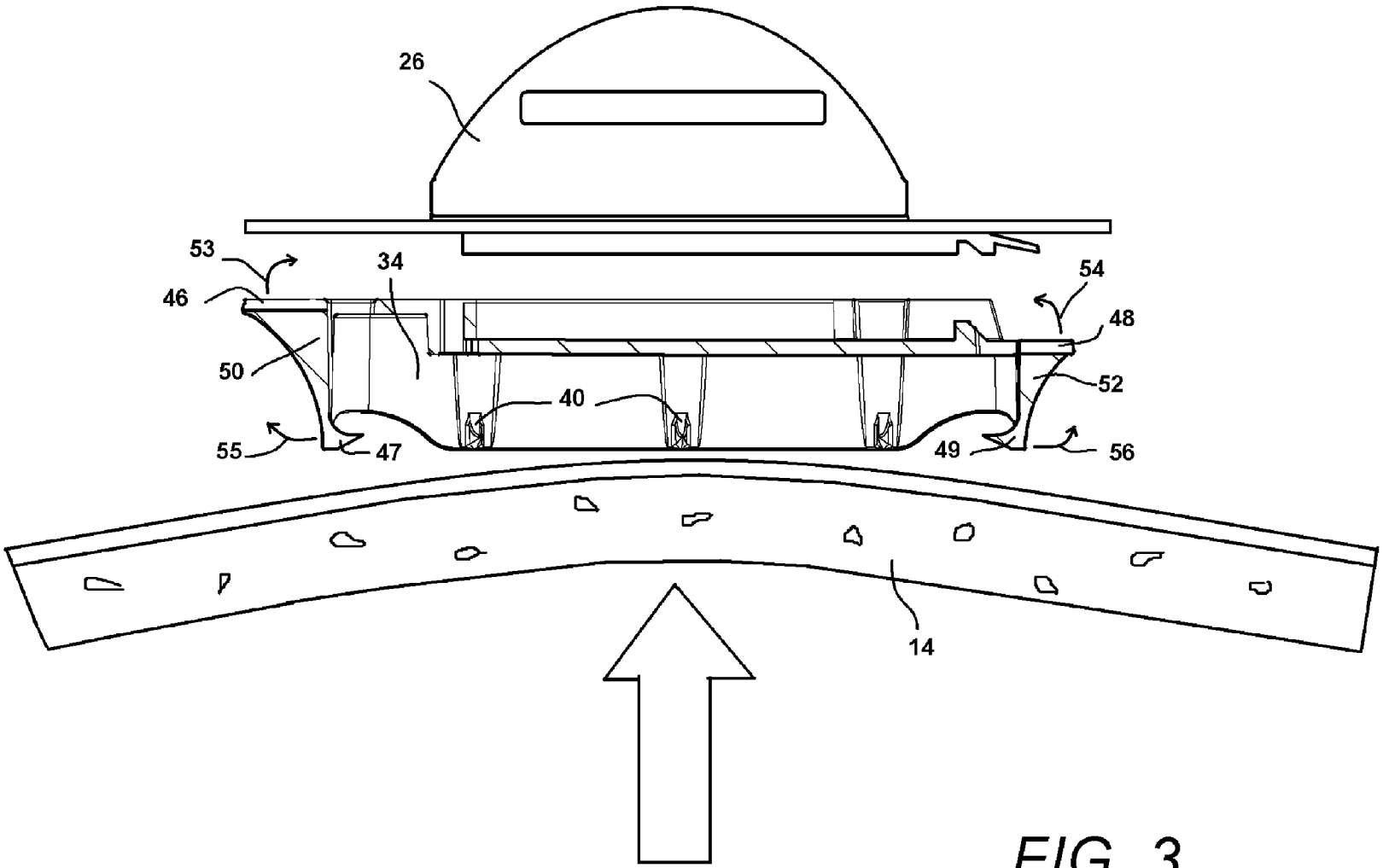
FIG. 3 is a cross-sectional view of the exemplary embodiment.

Referring to FIG. 3 in conjunction with both FIG. 1 and FIG. 2, it can be seen that a plurality of lateral hooks 40 extend inwardly from the interior of the vertical wall 32 near the open edge 36. The lateral hooks 40 extend at a perpendicular to the vertical wall 32 and into the receptacle space 34. Since the illustrated receptacle space 34 is oblong in shape, it will be understood that the vertical wall 32 that defines the receptacle space 34 has two opposing long sides 41, 42 and two opposing short sides 43, 44. At least one primary hook 47, 49 is molded onto each of the two opposing short sides 43, 44. In the area above each of the short sides 43, 44, the base plate 28 overextends the vertical wall 32 and extends past the vertical wall 32. This creates two cantilevered tabs 46, 48 on opposite sides of the base plate 28. Each of the tabs 46, 48 is connected to the corresponding short side 43, 44 of the vertical wall 32 by a connecting rib 50, 52. The tabs 46, 48 lay in an orientation that is perpendicular to the short sides 43, 44 of the vertical wall 32. This orientation is reinforced by the presence of the connecting ribs 50, 52. Consequently, it will be understood that if either tab 46, 48 is manually pulled up, in the directions shown by arrows 53, 54, then the connecting ribs 50, 52 cause the short sides 43, 44 of the vertical wall 32 to move out and away from one another in the directions of opposing arrows 55, 56. It will therefore be understood that the size of the receptacle space 34 can be temporarily enlarged by manually manipulating the tabs 46, 48.

Openings 58 are formed through the base plate 28 that lead into the receptacle space 34. The openings 58 are located in the base plate 28 directly above the lateral hooks 40. The openings 58 serve two purposes. First, the openings 58 enable tooling elements to form the lateral hooks 40 during an injection molding process. Secondly, the openings 58 enable fluids to flow into and out of the receptacle space 34 through the base plate 28.

The base plate 28 is not fully planar in shape. Rather, a female slot connector 60 is formed into the base plate 28. The female slot connector 60 is shaped and sized to receive and retain a male slot connector 62 that is provided at one end of the handle 26.

The handle 26 can have many shapes. In the illustrated embodiment, a short handle is shown so it can be illustrated to scale. However, it should be understood that an elongated handle can also be used. The handle 26 has a grasping area 64 at one end. At the other end is the male slot connector 62 that can selectively interconnect with the gripper head 24.

Figure 4:
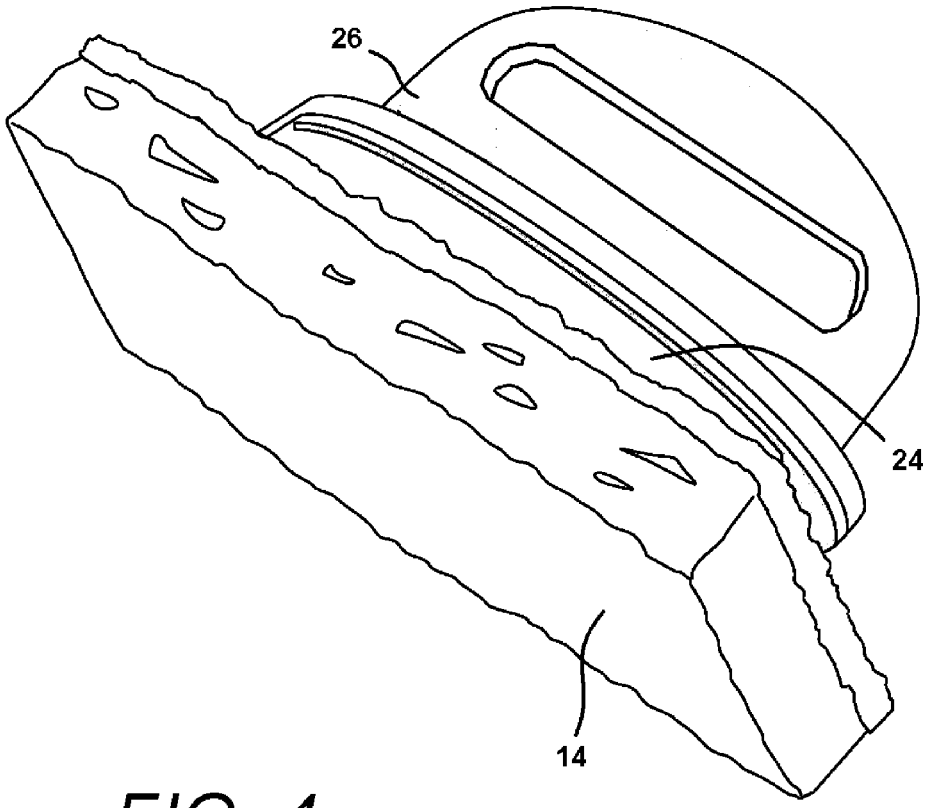
FIG. 4 is a perspective view of the exemplary embodiment shown as a full assembly.

Referring to FIG. 3 in conjunction with FIG. 4, it will be understood that in order for the sponge 14 to be attached to the gripper head 24, the gripper head 24 is first placed in abutment with the sponge 14 so that the open end of the receptacle space 34 is covered by the sponge 14. The center section of the sponge 14 is then pressed and deformed into the receptacle space 34 by a user's hands. As the sponge 14 enters the receptacle space 34, the sponge 14 becomes snagged on the lateral hooks 40 that extend into the receptacle space 34. As the lateral hooks 40 snare and enter the sponge 14, a mechanical interconnection occurs that connects the sponge 14 to the gripper head 24. The lateral hooks 40 are capable of snaring either the scrubbing nap 16 of the sponge 14 or the sponge material 20 of the sponge 14. It will therefore be understood that the sponge 14 can be attached to the gripper head 24 either nap side up, as illustrated, or nap side down.

Once the sponge 14 is interconnected with the gripper head 24, the sponge 14 can be manipulated by simply grasping and manipulating the connected handle 26. Most any sponge 14 can be attached to the gripper head 24. The thickness of the sponge 14 does not matter, nor does the area of the sponge 14 provided that the sponge 14 is larger than the receptacle space 34 of the griper head 24. However, it is preferred that the sponge 14 be significantly larger than the gripper head 24. In this manner, the sponge 14 is free to flex in use without the presence of the gripper head 24 causing any significant interference.

To remove the sponge 14 from the gripper head 24, the sponge 14 typically need only be manually manipulated to disengage the sponge 14 from the gripper head 24. To assist in this manipulation, the tabs 46, 48 can be pulled upwardly in the directions of arrows 53, 54. This disengages the primary lateral hooks 47, 49 along the short sides 43, 44 of the receptacle space 34. Once the primary lateral hooks 47, 49 are disengaged, it becomes easy to pull the sponge away from the remaining hooks 40.

It will be understood that the embodiment of the present invention that is illustrated and described is merely exemplary and that a person skilled in the art can make many variations to that embodiment. For instance, a sponge of a different shape and a gripper head of a different shape can be used. Likewise many different connectors can be used to selectively connect the gripper head to the handle. All such embodiments are intended to be included within the scope of the present invention as defined by the claims.

What is claimed is:

1. An assembly comprising:

a gripper head having a base plate with a top surface and a bottom surface, wherein a peripheral wall extends from said bottom surface at a perpendicular, wherein said base plate and said peripheral wall define a receptacle area, and wherein said base plate overextends said receptacle area, therein creating cantilevered tabs at opposing sides of said receptacle area, wherein said cantilevered tabs deform said opposing sides away from one another when manually manipulated;

hook elements protruding from said peripheral wall, wherein said hook elements all laterally extend into said receptacle area;

a handle extending from said top surface of said base plate;

a sponge having a top flat surface, a bottom flat surface and side surfaces that extend between said top flat surface and said bottom flat surface, wherein a partial segment of said top flat surface of said sponge is deformed into said receptacle area, wherein said top flat surface of said sponge deformed onto said receptacle area is hooked by said hook elements therein mechanically interconnecting said sponge with said gripper head.

2. The assembly according to claim 1, wherein said sponge contains a scrubbing nap layer on its top flat surface and said hook elements pierce said scrubbing nap.

3. The assembly according to claim 1, wherein said handle is selectively attachable to and detachable from said gripper head.

4. The assembly according to claim 1, wherein holes are formed through said base plate, wherein said holes extend into said receptacle area.

5. The assembly according to claim 1, wherein a connector is formed on said top surface of said base plate for selectively receiving and engaging part of said handle.

6. The assembly according to claim 1, wherein said hook elements include two primary hook elements and wherein said peripheral wall has opposing surfaces under said cantilevered tabs, wherein one of said primary hook elements extend inwardly into said receptacle area from each of said opposing surfaces.

7. An auxiliary handle assembly for a cleaning sponge comprising:

a gripper head having a base plate and a peripheral wall extending downwardly at a perpendicular from said base plate, said peripheral wall having opposing surfaces, wherein said base plate and said peripheral wall define a receptacle space, and wherein tabs are connected to said peripheral wall that deforms said opposing surfaces away from one another when said tabs are manually manipulated;

hook elements that extend at a perpendicular from said peripheral wall into said receptacle space;

a handle affixed to said base plate of said gripper head.

8. The assembly according to claim 7, wherein said handle is selectively attachable to, and detachable from, said gripper head.

9. The assembly according to claim 8, wherein a connector is formed on a top surface of said base plate for selectively receiving and engaging part of said handle.

10. The assembly according to claim 7, wherein holes are formed through said base plate, wherein said holes extend into said receptacle space.

11. The assembly according to claim 7, wherein said hook elements include at least one primary hook element that extends inwardly from each of said opposing surfaces.

12. The assembly according to claim 7, wherein said tabs include sections of said base plate that overextend said peripheral wall.

13. A method of attaching an auxiliary handle to a cleaning sponge, said method comprising the steps of:

providing a gripper head having a receptacle area defined within a peripheral wall, wherein hook elements extend at a perpendicular from said peripheral wall into said receptacle area;

providing a handle;

attaching said handle to said gripper head;

providing a sponge having a top surface that is initially flat;

deforming a partial segment of said top surface of said sponge into said receptacle area, wherein said partial segment of said sponge deformed into said receptacle area is hooked by said hook elements, therein mechanically interconnecting said sponge with said gripper head.

14. The assembly according to claim 13, wherein said sponge has a top flat surface, a bottom flat surface and side surfaces that extend between said top flat surface and said bottom flat surface, wherein said top flat surface is deformed into said receptacle area and wherein said hook elements pierce said top flat surface.

* * * * *